US005757119A

United States Patent [19]

Togawa

[11] Patent Number: 5,757,119

[45] Date of Patent: May 26, 1998

[54] COLOR CATHODE RAY TUBE

[75] Inventor: Masaru Togawa, Shiga, Japan

[73] Assignee: Nec Corporation, Tokyo, Japan

[21] Appl. No.: 707,989

[22] Filed: Feb. 21, 1996

[30] Foreign Application Priority Data

Feb. 21, 1995 [JP] Japan ..... 7-032091

[51] Int. Cl.[6] ..... H01J 29/07

[52] U.S. Cl. ..... 313/402; 313/403; 313/407; 313/408; 313/422

[58] Field of Search ..... 313/402, 403, 313/407, 408, 422

[56] References Cited

U.S. PATENT DOCUMENTS

| | | | |
|---|---|---|---|
| 4,540,374 | 9/1985 | Kamohara | 445/37 |
| 4,671,776 | 6/1987 | Tokita | 313/402 |
| 4,733,125 | 3/1988 | Tokita | 313/402 |

FOREIGN PATENT DOCUMENTS

| | | |
|---|---|---|
| 60-148036 | 8/1985 | Japan . |
| 64-38941 | 2/1989 | Japan . |

*Primary Examiner*—Sandra L. O'Shea
*Assistant Examiner*—Joseph Williams
*Attorney, Agent, or Firm*—Sughrue, Mion, Zinn, Macpeak & Seas, PLLC

[57] ABSTRACT

A color cathode ray tube (CRT) has a panel having a fluorescent film consisting of a number of groups of phosphors each radiating in a particular color. A shadow mask adjoins the fluorescent film and is formed with a number of apertures by etching. Electron guns are located at the side opposite to the fluorescent film with respect to the shadow mask, and emit electron beams for causing the phosphors to radiate. An insulating glass layer covers the edges of the apertures on the side of the shadow mask that faces the fluorescent film. The glass layer increases the mechanical strength of the shadow mask and enhances landing accuracy.

2 Claims, 3 Drawing Sheets

COLOR CATHODE RAY TUBE

BACKGROUND OF THE INVENTION

The present invention relates to a color cathode ray tube (CRT) having a shadow mask and, more particularly, to a color CRT whose shadow mask is mechanically strong and highly transmissive to electron beams and feasible for a high definition configuration.

In a color CRT having a shadow mask, a deflection yoke forms a magnetic field for horizontal deflection and a magnetic field for vertical deflection. Electron beams emitted from three electron guns scan a fluorescent film while being deflected by the above electric fields. Specifically, the electron beams are selectively passed through the apertures of a shadow mask to impinge on phosphors of corresponding colors and constituting the fluorescent film. As a result, the fluorescent film radiates to display an image.

Usually, the apertures of the shadow mask are regularly arranged in horizontal parallel arrays in a mosaic configuration. The apertures have a constant pitch in the vertical direction of a screen. Only less than one-third of the electron beams is allowed to pass through the apertures due to the configuration of the mask. The rest of the electron beams impinge on the mask and are transformed to thermal energy.

As a result, the mask is heated, sometimes up to about 80° C., and caused to expand at its central portion. Such a phenomenon is generally referred to as doming.

A glass layer having a low conductivity may cover the side of the shadow mask that faces the electron beams in order to obviate the above doming phenomenon, as taught in Japanese Patent Laid-Open Publication No. 60-148036. The glass layer obstructs heat conduction ascribable to the electron beams impinging on the mask. Also, a color CRT of the above document eliminates the mislanding of the electron beams due to the electrostatic deflection of the beams which is ascribable to the charging of the glass layer. Japanese Patent Laid-Open Publication No. 64-38941 proposes a color CRT including an anti-doming substance sprayed onto both sides of a shadow mask, and conductive films formed on the resulting layers of the anti-doming substance.

In all the prior art color CRTs described above, glass in the form of a film covers the side of the shadow mask that faces the electron beams. Hence, the electron beams scanning the entire shadow mask impinge on the glass and cause it come off due to the temperature elevation of the glass itself as well as the heat cycle. Moreover, because the glass is not even in property due to variations and irregularities in the production process, the charge of the glass becomes uneven to cause an uneven pattern to appear on the screen. In regard to the use of a conductive film, the shadow mask proposed by the above Laid-Open Publication No. 64-38941 needs a complicated production process and thereby increases the number of steps and the production cost.

SUMMARY OF THE INVENTION

It is therefore an object of the present invention to provide a color CRT having a mechanically strong shadow mask and capable of enhancing accurate landing.

A color CRT of the present invention has a panel having a fluorescent film consisting of a number of groups of phosphors each radiating in a particular color. A shadow mask adjoins the fluorescent film and is formed with a number of apertures by etching. Electron guns are located at the side opposite to the fluorescent film with respect to the shadow mask, and emit electron beams for causing the phosphors to radiate. An insulating glass layer covers the edges of the apertures on the side of the shadow mask that faces the fluorescent film.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
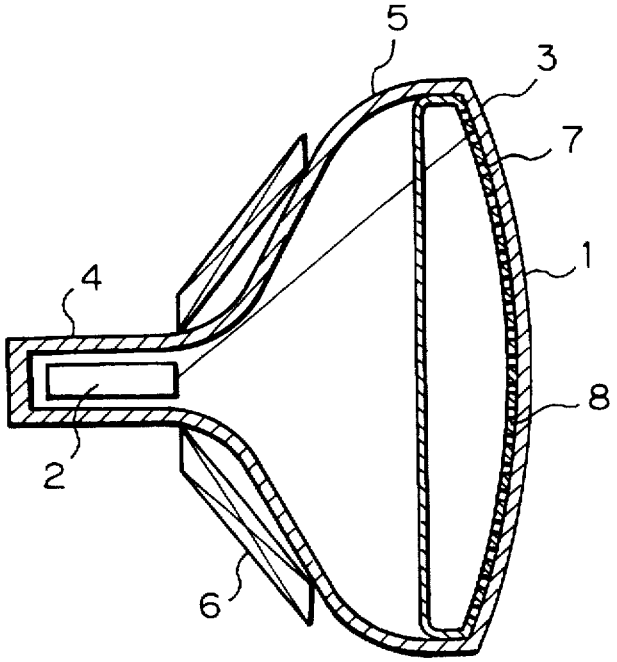
Fig. 1 PRIOR ART
FIG. 1 is a section showing a conventional color CRT having a shadow mask.

To better understand the present invention, a brief reference will be made to a conventional shadow mask type color CRT, shown in FIG. 1. As shown, the CRT has a panel 1 on which an image is to be displayed. A fluorescent film 3 is formed on the inner surface of the panel 1 and made up of a number of arrays of three-color fluorescent stripes. The arrays extend vertically perpendicularly to the scanning lines of electron beams to issue from three electron guns 2 which are arranged in an in-line configuration. A generally conical funnel 5 has a tubular neck portion 4 and is connected to the panel 1 to form a vacuum casing. The electron guns 2 are disposed in the neck portion 4. A deflection yoke 6 surrounds the funnel 5 in order to deflect the electron beams. A shadow mask 8 faces the fluorescent film 3 provided on the panel 1. The shadow mask 8 is formed with a number of rectangular apertures 7 for selectively passing the electron beams therethrough. The deflection yoke 6 forms a magnetic field for horizontal deflection and a magnetic field for vertical deflection. The electron beams emitted from the three electron guns 2 scan the entire fluorescent film 3 while being deflected by the above electric fields. Specifically, the electron beams are selectively passed through the apertures 7 of the shadow mask 8 to impinge on the phosphors of corresponding colors and constituting the fluorescent film 3. As a result, the fluorescent film 3 radiate to display an image.

Figure 2:
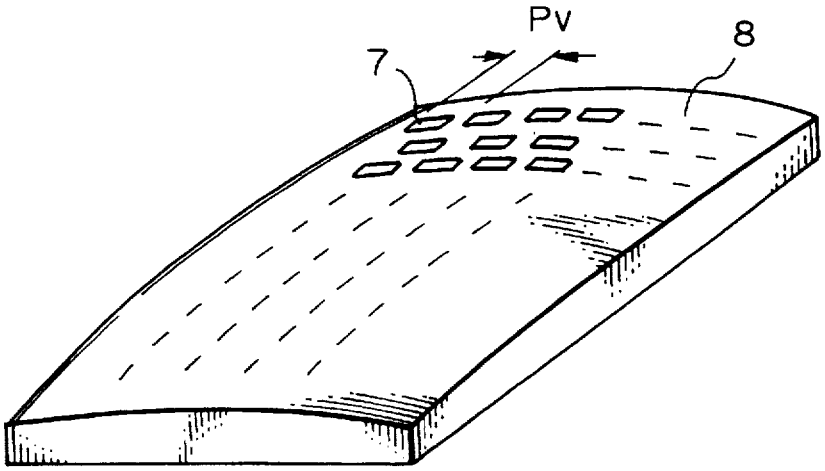
Fig. 2 PRIOR ART
FIG. 2 is a perspective view of the shadow mask shown in FIG. 1.

As shown in FIG. 2, the apertures 7 of the mask 8 are regularly arranged in horizontal parallel arrays in a mosaic configuration. The apertures 7 have a constant pitch Pv in the vertical direction of the screen. Only less than one-third of the electron beams is allowed to pass through the apertures 7 due to the configuration of the mask 8. The rest of the electron beams impinge on the mask 8 and are transformed to thermal energy. As a result, the mask 8 is heated, sometimes up to about 80° C., and caused to expand at its central portion, i.e., doming.

Figure 3:
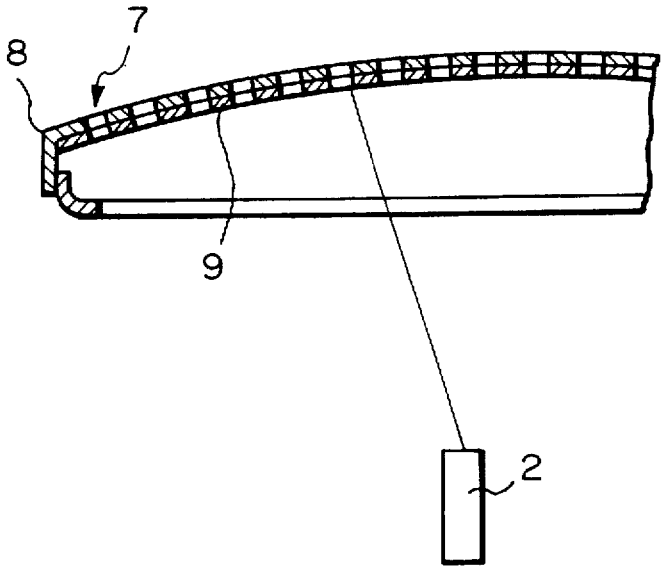
Fig. 3 PRIOR ART
FIG. 3 is a fragmentary section of a shadow mask included in another conventional color CRT.

FIG. 3 shows an essential part of a shadow mask type color CRT provided with a measure against doming, as taught in previously mentioned Japanese Patent Laid-Open Publication No. 60-148036. As shown, a glass layer 9 having a low conductivity covers the side of the shadow mask 8 that faces the electron beams. The glass layer 9 obstructs heat conduction ascribable to the electron beams impinging on the mask 8. Also, the CRT eliminates the mislanding of the electron beams due to the electrostatic deflection of the beams which is ascribable to the charging of the glass layer 9.

Figure 4:
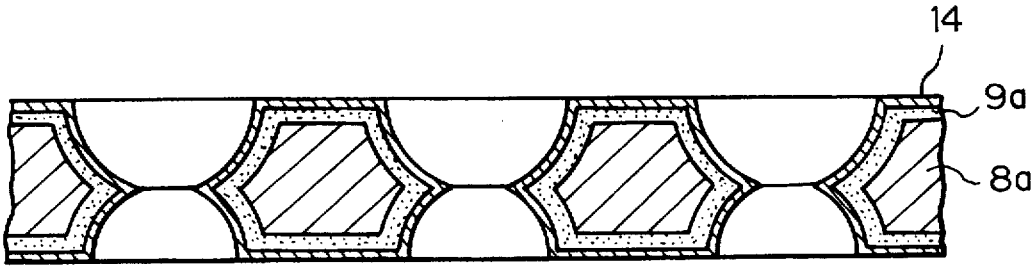
Fig. 4 PRIOR ART
FIG. 4 is a fragmentary section of a shadow mask included in still another conventional color CRT.

FIG. 4 shows an essential part of a shadow mask type color CRT disclosed in previously mentioned Japanese Patent Laid-Open Publication No. 64-38941. As shown, an anti-doming substance 9*a* is sprayed onto both sides of a shadow mask 8*a*. Conductive films 14 are formed on the resulting layers of the substance 9*a*.

In all the prior art color CRTs described above, glass in the form of a film covers the side of the shadow mask that faces the electron beams. This brings about a problem that the film partly comes off due to the temperature elevation of the glass itself as well as the heat cycle, and a problem that the charge of the glass becomes uneven to cause an uneven pattern to appear on the screen, as discussed earlier. Particularly, the shadow mask shown in FIG. 4 needs a complicated production process and thereby increases the number of steps and the production cost.

Figure 5:
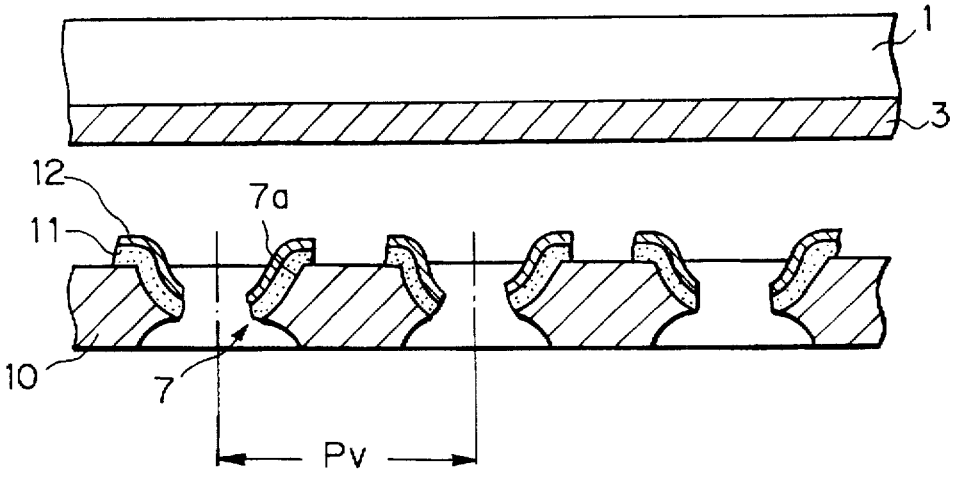
FIG. 5 is a fragmentary section of a shadow mask included in a color CRT embodying the present invention.
Figure 6:
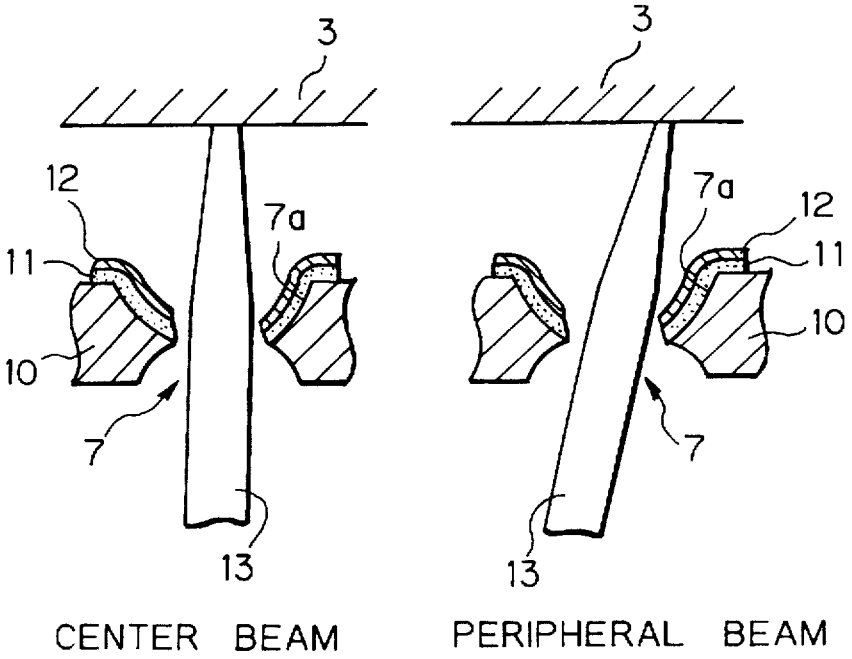
FIG. 6 is a section showing how electron beams are converted by the embodiment shown in FIG. 5.

Referring to FIGS. 5 and 6, a shadow mask type color CRT embodying the present invention will be described. In FIGS. 5 and 6, the same or similar constituents as or to the constituents of FIGS. 1–4 are designated by the same reference numerals, and a detailed description thereof will not be made in order to avoid redundancy.

As shown, the CRT includes a shadow mask 10 formed of an Invar alloy having a coefficient of thermal expansion of $50\times10^{-7}/°C$. The mask 10 is formed with a number of rectangular apertures 7. The apertures 7 of the mask 10 are regularly arranged in horizontal parallel arrays in a mosaic configuration. The apertures 7 have a constant pitch Pv in the vertical direction of a screen. On the side of the mask 10 that faces a fluorescent film 3 of a panel 1, the apertures 7 have their edges 7*a* covered with a glass layer 11 made of borosilicate glass whose coefficient of thermal expansion is $45\times10^{-7}/°C$. Further, the glass layer 11 is covered with a thin film 12 of aluminum or similar conductive metal.

The glass layer 11 is formed on the mask 10 by the following procedure. A glass slurry is prepared by dispersing borosilicate glass powder in a butyl alcohol acetate solution in which, e.g., several percent of nitrocellulose is melted. The glass slurry is sprayed onto the side of the mask 10 that faces the fluorescent film 3. Subsequently, the mask 10 is mounted to a preselected frame, baked temporarily at about 100° C. in order to remove a binder, and then conveyed through a furnace to be heated at 500° C. for about 40 minutes. As a result, the smooth glass layer 11 is formed on the connecting portions of the mask 10. Thereafter, the conductive thin film 12 is formed on the glass layer 11 by chemical vacuum deposition or similar technology.

To deposit the glass only on the edges 7*a* of the apertures 7, the glass layer 11 may be formed beforehand by, e.g., a photoresist method. An alternative method consists of causing the glass to flow on the surface of the mask 10, and blowing air onto the mask 10 so as to force the glass inward along the edges 7*a*, while blowing air from the other side so as to prevent the glass from stopping up the apertures 7.

The glass layer 11 reinforces the connecting portions of the mask 10. In addition, after the glass has been hardened, some compression stress acts on the glass due to the difference in coefficient of thermal expansion between the glass and the mask 10. Hence, the mask 10 achieves an improved mechanical strength. Further, the conductive thin film 12 is formed on the glass layer 11 and electrically insulated from the mask 10. Hence, the glass layer 11 on the edges 7*a* of the mask 10 facing the fluorescent film 3 is charged by secondary electrons emitted from the film 3, forming electrostatic lenses. As a result, as shown in FIG. 6, electron beams 13 are converted by the electrostatic lenses and have their spot diameter reduced on the fluorescent film 3. This successfully increases the landing margin or landing accuracy.

In summary, in accordance with the present invention, a color CRT has a shadow mask formed with a number of apertures by etching and having the edges of the apertures, which are thin and narrow, covered with a glass layer for reinforcement. This increases the mechanical strength of the shadow mask. Moreover, the glass layer is charged only by secondary electrons emitted from a fluorescent film due to electron beams. Electrostatic lenses derived from the above charge are used to converge the electron beams. As a result, the electron beams have their diameter reduced on the fluorescent film, thereby enhancing accurate landing. Specifically, because the edges of the apertures formed by etching are covered with an insulating glass layer, the portions of the mask around the apertures, which lower the mechanical strength, are directly reinforced. In addition, because the electrostatic lenses are available at the edges of the apertures, the glass does not have to be deposited on needless portions and thereby simplifies the production process.

Furthermore, because the glass layer has a smaller coefficient of thermal expansion than the mask, a compression stress acts on the glass after hardening in the vicinity of the apertures which are the major cause of the decrease in mechanical strength. In addition, a conductive layer is formed on the glass layer and electrically insulated from the mask. Because the conductive layer serves to set up a uniform charge distribution on the glass layer, the electrostatic lenses can converge the electron beams, i.e., the spot diameter on the fluorescent film stably.

Various modifications will become possible for those skilled in the art after receiving the teachings of the present disclosure without departing from the scope thereof. For example, the shadow mask 10 may be implemented by a cold strip steel sheet while the glass layer 11 may be implemented by lead borate glass or similar glass smaller in the coefficient of thermal expansion than the steel sheet. An oxide layer may be provided between the glass layer 11 and the mask 10 in order to enhancing sealability, if desired. Further, the glass layer 11 may be provided with a laminate structure. The conductive thin film 12 may be omitted if allowable in the design aspect, although the omission of the film 12 will deteriorate the beam converging effect.

What is claimed is:

1. A color cathode ray tube (CRT) comprising:

a panel having a fluorescent film comprising a number of groups of phosphors each radiating in a particular color;

a shadow mask positioned in spaced relationship to said fluorescent film and formed with a number of apertures by etching;

electron beam focusing means disposed on a side of said shadow mask facing said fluorescent film, said focusing means comprising:

an insulating glass layer covering edges of said apertures exclusively on a side of said shadow mask that faces said fluorescent film;

and a conductive layer formed on said insulating glass layer and electrically insulated from said shadow mask, whereby charge is deposited on said insulating glass layer in a uniform distribution; and electron guns located at a side of said shadow mask opposite from said fluorescent film and said insulating glass layer, and for emitting electron beams for causing said number of groups of phosphors to radiate.

2. A color CRT as claimed in claim 1, wherein said glass layer comprises glass having a coefficient of thermal expansion that is smaller than a coefficient of expansion of said shadow mask, whereby a compression stress acts on said glass layer.

* * * * *